US008813498B2

(12) United States Patent
Kopecek et al.

(10) Patent No.: US 8,813,498 B2
(45) **Date of Patent: *Aug. 26, 2014**

(54) TURBINE INLET CONDITION CONTROLLED ORGANIC RANKINE CYCLE

(75) Inventors: Herbert Kopecek, Hallbergmoos (DE); Gabor Ast, Garching (DE); Thomas Johannes Frey, Regensburg (DE); Pierre Sebastien Huck, Munich (DE)

(73) Assignee: General Electric Company, Niskayuna, NY (US)

( * ) Notice: Subject to any disclaimer, the term of this patent is extended or adjusted under 35 U.S.C. 154(b) by 635 days.

This patent is subject to a terminal disclaimer.

(21) Appl. No.: 12/818,234

(22) Filed: Jun. 18, 2010

(65) Prior Publication Data

US 2011/0308252 A1 Dec. 22, 2011

(51) Int. Cl.
*F01K 7/34* (2006.01)
*F01K 13/02* (2006.01)
*F04B 49/00* (2006.01)

(52) U.S. Cl.
USPC ..... 60/653; 60/660; 415/1; 415/17

(58) Field of Classification Search
USPC ..... 60/645–681
See application file for complete search history.

(56) References Cited

U.S. PATENT DOCUMENTS 4,005,581 A * 2/1977 Aanstad ..... 60/660
4,028,884 A 6/1977 Martz et al.
4,117,344 A * 9/1978 Boerstler et al. ..... 290/52
4,297,848 A * 11/1981 Silvestri, Jr. ..... 60/660
4,484,446 A 11/1984 Goldsberry
5,136,848 A * 8/1992 Silvestri, Jr. ..... 60/646
5,560,210 A * 10/1996 Bronicki ..... 60/648
5,685,154 A * 11/1997 Bronicki et al. ..... 60/648
5,832,421 A 11/1998 Santoso et al.
6,981,377 B2 * 1/2006 Vaynberg et al. ..... 60/641.8
7,036,315 B2 * 5/2006 Kang et al. ..... 60/653
7,121,906 B2 10/2006 Sundel
7,124,589 B2 10/2006 Neary
7,200,996 B2 * 4/2007 Cogswell et al. ..... 60/651
7,665,304 B2 2/2010 Sundel (Continued)

FOREIGN PATENT DOCUMENTS

JP 5937212 A 2/1984

OTHER PUBLICATIONS

Search Report and Written Opinion from corresponding PCT Application No. PCT/US2011/036578 dated Sep. 4, 2013.

*Primary Examiner* — Thomas Denion
*Assistant Examiner* — Ngoc T Nguyen
(74) *Attorney, Agent, or Firm* — Ann M. Agosti

(57) ABSTRACT

A pressure sensor measures an organic Rankine cycle (ORC) working fluid pressure in front of a radial inflow turbine, while a temperature sensor measures an ORC working fluid temperature in front of the radial inflow turbine. A controller responsive to algorithmic software determines a superheated temperature of the working fluid in front of the radial inflow turbine based on the measured working fluid pressure and the measured working fluid temperature. The controller then manipulates the speed of a working fluid pump, the pitch of turbine variable inlet guide vanes when present, and combinations thereof, in response to the determined superheated temperature to maintain the superheated temperature of the ORC working fluid in front of the radial inflow turbine close to a predefined set point. The superheated temperature can thus be maintained in the absence of sensors other than pressure and temperature sensors.

15 Claims, 8 Drawing Sheets

(56) References Cited

U.S. PATENT DOCUMENTS

| | | | | |
|---|---|---|---|---|
| 8,186,161 | B2 * | 5/2012 | Ast et al. | 60/660 |
| 2003/0213246 | A1 * | 11/2003 | Coll et al. | 60/653 |
| 2005/0247056 | A1 | 11/2005 | Cogswell et al. | |
| 2006/0112693 | A1 | 6/2006 | Sundel | |
| 2006/0168963 | A1 * | 8/2006 | Sato et al. | 60/645 |
| 2008/0252078 | A1 * | 10/2008 | Myers et al. | 290/52 |
| 2009/0071156 | A1 * | 3/2009 | Nishikawa et al. | 60/660 |
| 2009/0151356 | A1 | 6/2009 | Ast et al. | |
| 2010/0186410 | A1 * | 7/2010 | Cogswell et al. | 60/671 |
| 2011/0203278 | A1 * | 8/2011 | Kopecek et al. | 60/660 |

* cited by examiner

TURBINE INLET CONDITION CONTROLLED ORGANIC RANKINE CYCLE

BACKGROUND

This invention relates generally to organic Rankine cycle plants, and more particularly to methods and apparatus for controlling organic Rankine cycles using radial inflow turbines.

Rankine cycles use a working fluid in a closed cycle to gather heat from a heating source or a hot reservoir by generating a hot gaseous stream that expands through a turbine to generate power. The expanded stream is condensed in a condenser by rejecting the heat to a cold reservoir. The working fluid in a Rankine cycle follows a closed loop and is re-used constantly.

Superheated conditions at the inlet (front end) of the ORC turbine are required under all operation modes to avoid reduced turbine life expectancy or even immediate damage. In this regard, fixed speed turbines have only a low influence on vaporization and provide only a weak means for controls. Further, turbines devoid of variable inlet guide vanes are also devoid of means for controlling vaporization.

In view of the foregoing, it would be advantageous to provide efficient and cost effective methods and apparatus for controlling organic Rankine cycles using radial inflow turbines. The methods and apparatus should be capable of maintaining a desired superheating temperature at all operating conditions at the ORC turbine inlet without using sensors other than pressure and temperature sensors.

BRIEF DESCRIPTION

According to one embodiment, an organic Rankine cycle (ORC) plant comprises:

an evaporator configured to receive a working fluid from a pump and to generate a vapor stream there from;

a radial inflow turbine configured to receive the vapor stream and to generate power and an expanded stream there from;

a condenser configured to receive the expanded stream and to generate the working fluid there from, wherein the working fluid and the vapor stream together form a closed ORC loop;

at least one pressure sensor configured to measure working fluid pressure at the inlet side of the radial inflow turbine;

at least one temperature sensor configured to measure working fluid temperature at the inlet side of the radial inflow turbine;

an algorithmic software configured to determine a superheated temperature at the inlet side of the radial inflow turbine based solely on the measured working fluid pressure, the measured working fluid temperature, and a saturated vapor line temperature of the working fluid; and a superheat controller configured manipulate at least one of the speed of the pump, the pitch of turbine variable inlet guide vanes when the turbine comprises variable inlet guide vanes, and combinations thereof, in response to the determined superheated temperature to substantially maintain the superheated temperature at the inlet side of the radial inflow turbine at a predefined set point.

According to another embodiment, an organic Rankine cycle (ORC) control system comprises:

at least one pressure sensor configured to measure ORC working fluid pressure at the inlet side of a radial inflow turbine;

at least one temperature sensor configured to measure ORC working fluid temperature at the inlet side of the radial inflow turbine;

an algorithmic software configured to determine a superheated temperature at the inlet side of the radial inflow turbine based solely on the measured working fluid pressure, the measured working fluid temperature, and a saturated vapor line temperature of the working fluid; and a superheat controller configured manipulate at least one of the speed of a working fluid pump, the pitch of turbine variable inlet guide vanes when the turbine comprises variable inlet guide vanes, and combinations thereof, in response to the determined superheated temperature to substantially maintain the superheated temperature of the working fluid at the inlet side of the radial inflow turbine at a predefined set point.

According to yet another embodiment, a method of controlling an organic Rankine cycle (ORC) superheated temperature, the method comprising:

measuring ORC working fluid pressure at the inlet side of a radial inflow turbine;

measuring ORC working fluid temperature at the inlet side of the radial inflow turbine;

determining a superheated temperature at the inlet side of the radial inflow turbine based on the measured working fluid pressure, the measured working fluid temperature, and a saturated vapor line temperature of the working fluid; and manipulating at least one of the speed of an ORC working fluid pump, the pitch of turbine variable inlet guide vanes when the turbine comprises variable inlet guide vanes, and combinations thereof, in response to the determined superheated temperature to substantially maintain the superheated temperature of the working fluid at the inlet side of the radial inflow turbine at a predefined set point.

DRAWINGS

These and other features, aspects, and advantages of the present invention will become better understood when the following detailed description is read with reference to the accompanying drawing, wherein.

While the above-identified drawing figures set forth particular embodiments, other embodiments of the present invention are also contemplated, as noted in the discussion. In all cases, this disclosure presents illustrated embodiments of the present invention by way of representation and not limitation. Numerous other modifications and embodiments can be devised by those skilled in the art which fall within the scope and spirit of the principles of this invention.

DETAILED DESCRIPTION

Figure 1:
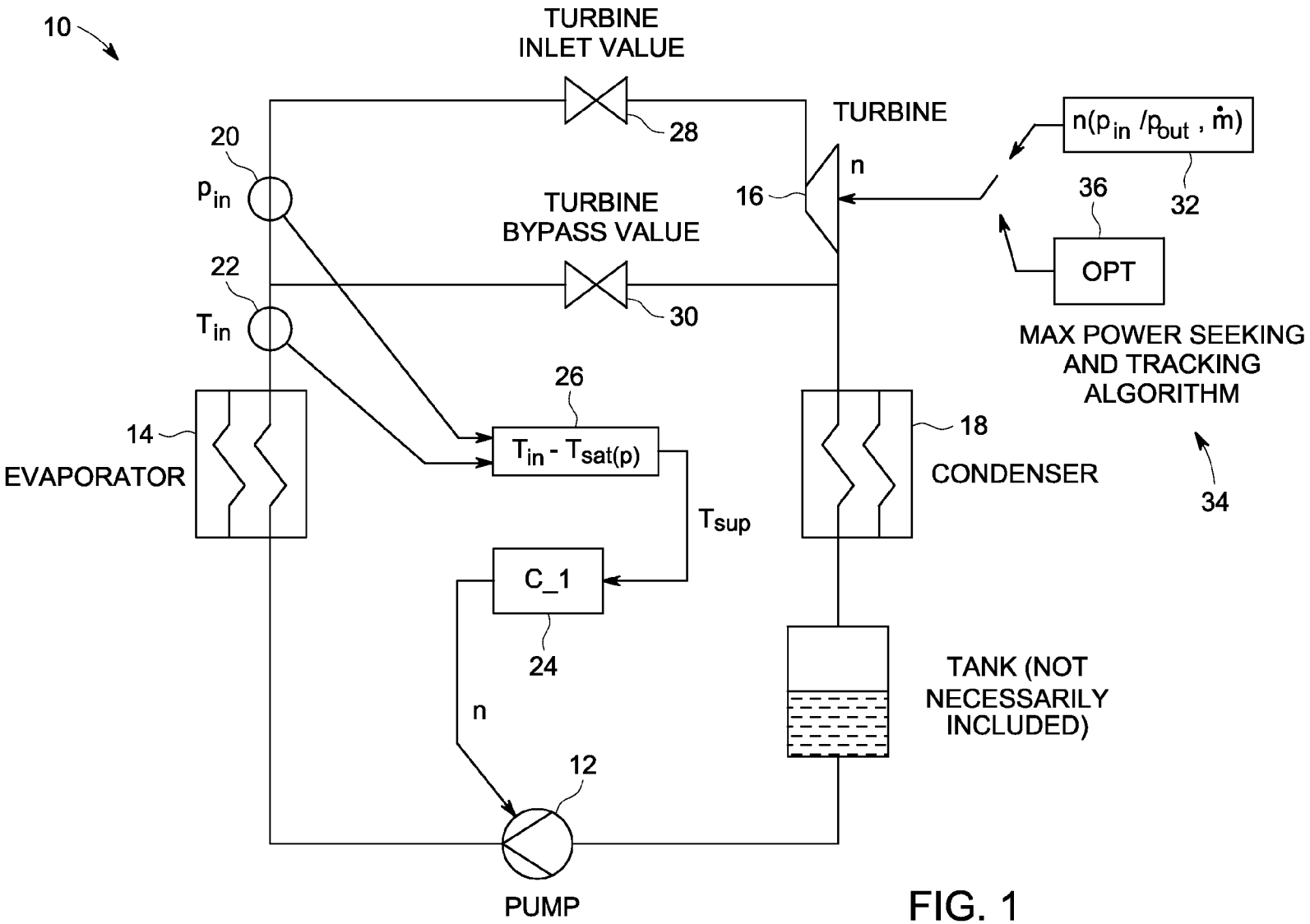
FIG. 1 illustrates an organic Rankine cycle (ORC) plant with superheated temperature control according to one embodiment.

FIG. 1 illustrates an organic Rankine cycle (ORC) plant 10 with superheated temperature control according to one embodiment. The ORC working fluid is pumped (ideally isentropically) from a low pressure to a high pressure by a pump 12. Pumping the working fluid from a low pressure to a high pressure requires a power input (for example mechanical or electrical). The high-pressure liquid stream enters the evaporator (boiler) 14 where it is heated to become a saturated vapor stream. Common heat sources for organic Rankine cycles are exhaust gases from combustion systems (power plants or industrial processes), hot liquid or gaseous streams from industrial processes or renewable thermal sources such as geothermal or solar thermal. The superheated or saturated vapor stream expands through the expander (turbine) 16 to generate power output. In one embodiment, this expansion is isentropic. The expansion decreases the temperature and pressure of the vapor stream. The vapor stream then enters a condenser 18 where it is cooled to generate a saturated liquid stream. This saturated liquid stream re-enters the pump 12 to generate the working fluid and the cycle repeats.

ORC plant 10 further comprises one or more working fluid pressure sensors 20 configured to measure the working fluid pressure at the inlet side (front end) of the turbine 16. According to one embodiment, the turbine is a variable speed radial inflow turbine comprising variable inlet guide vanes to control superheat temperature in front (inlet) of the turbine and/or optimization of power output or plant efficiency (e.g. under different ambient conditions such as, for example, summer and winter modes). The ORC plant 10 may also comprise one or more working fluid temperature sensors 22 that are configured to measure the working fluid temperature at the inlet side (front end) of the turbine 16.

A superheat temperature controller 24 responsive to an algorithmic software 26 that is recorded on a non-transient computer readable medium embedded within superheat controller 24, calculates the superheated temperature of the working fluid at the inlet side of the turbine 16. The superheated temperature is determined from the measured working fluid pressure, the measured working fluid temperature and from a lookup table that is recorded on a non-transient computer readable medium embedded within superheat controller 24 and comprising saturated vapor line temperatures of the working fluid as a function of the working fluid pressure. Superheat temperature controller 24 functions to keep the superheated temperature of the working fluid at the inlet side of the turbine 16 close to a predefined set point (e.g. 10°) by manipulating the pump 12 speed, and as a consequence, pressure and mass flow inside the system 10.

According to one embodiment, ORC plant 10 further comprises a turbine inlet valve 28 and a bypass valve 30 that together function to protect the turbine 16 from wet inlet conditions during transient operation phases such as during start up and shut down of the ORC plant 10. According to one aspect, the turbine inlet valve 28 will remain closed and the bypass valve will remain open whenever wet conditions are expected under these modes of operation.

Turbine 16 speed (n) is set according to one embodiment in response to a map 32 stored in the superheat temperature controller 24. According to one aspect, the map 32 provides a desired set point for turbine speed based on input/output pressure ratios and mass flow data. According to another aspect, the desired set point is further based on ambient temperature and heat load data.

According to another embodiment, ORC plant 10 comprises an optimizing algorithm 34 that is recorded on a non-transient computer readable medium stored in an optimizing controller 36. Optimizing algorithm 34 seeks a maximum turbine power output by varying the turbine speed and/or pitch of variable inlet guide vanes (IGV)s. According to one aspect, optimizing algorithm 34 tracks the maximum power point for changing ambient conditions (e.g. temperature day vs. night).

According to one embodiment, the superheat temperature controller 24 and the optimizing controller 36 coexist on the same control platform allowing the turbine speed map 32 to be continuously auto-improved via the optimizing controller 36.

According to one embodiment, the superheat temperature controller 24 and the optimizing controller 36 coexist on the same control platform allowing the turbine speed map 32 to be continuously auto-improved via the optimizing controller 34.

Figure 5:
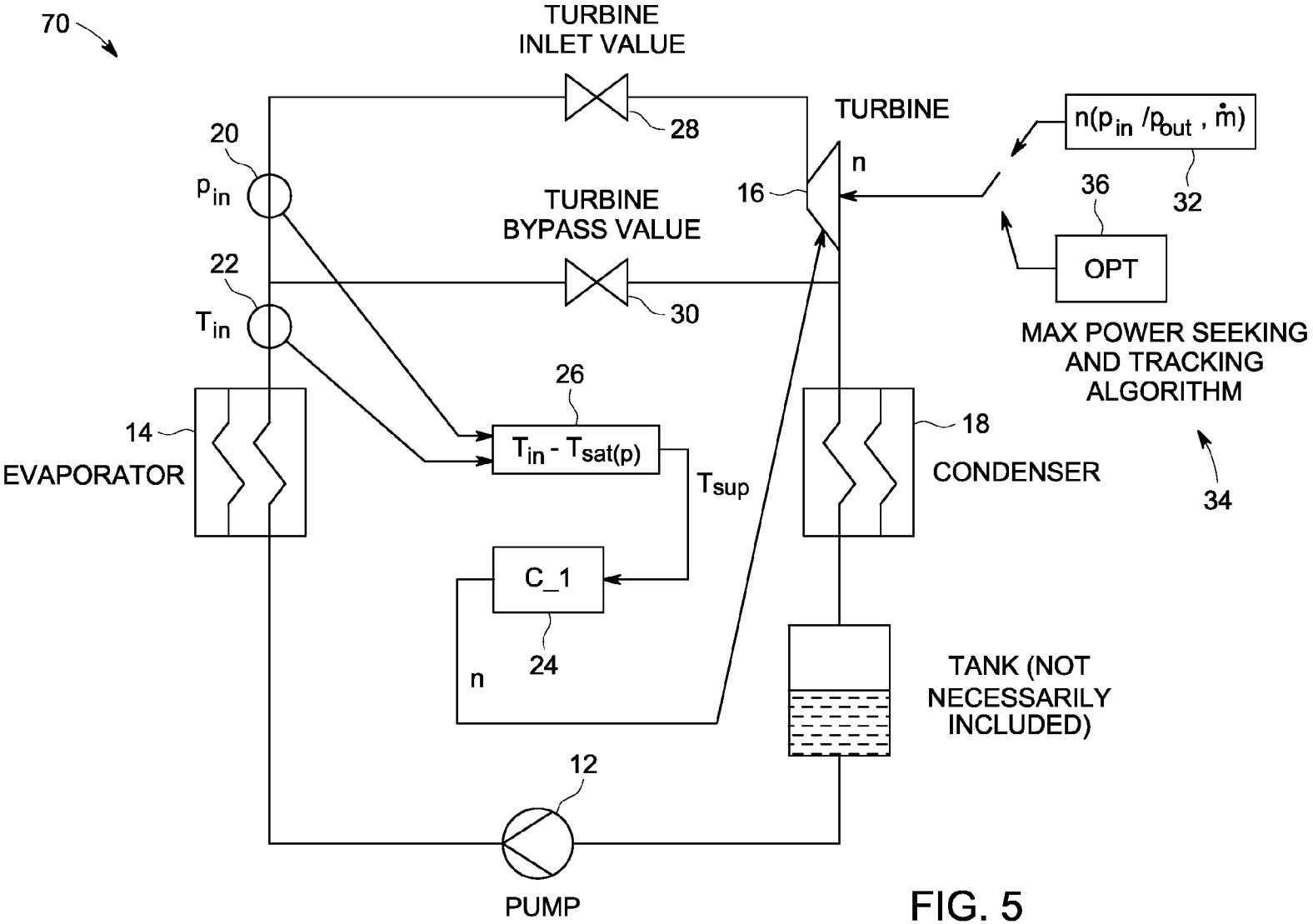
FIG. 5 illustrates an organic Rankine cycle (ORC) plant with superheated temperature control according to another embodiment.

Superheat temperature controller 24 can also be configured to keep the superheated temperature of the working fluid at the inlet side of the turbine 16 close to a predefined set point (e.g. 10°) by manipulating the pitch of variable inlet guide vanes as shown for the ORC plant 70 in FIG. 5 when the radial inflow turbine comprises variable IGVs, as stated herein.

Figure 2:
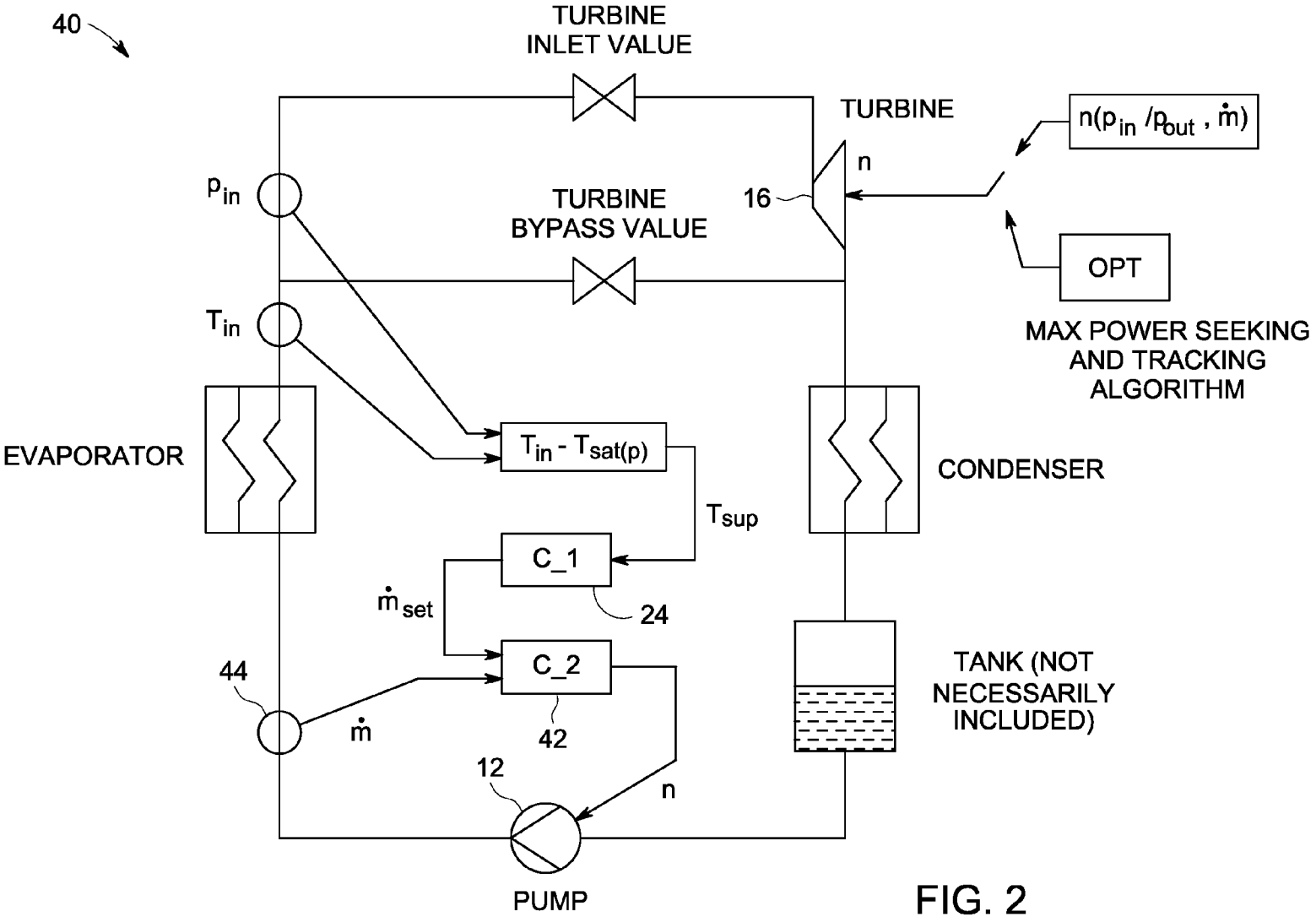
FIG. 2 illustrates an organic Rankine cycle plant with superheated temperature control and subsequent mass flow control according to one embodiment.
Figure 6:
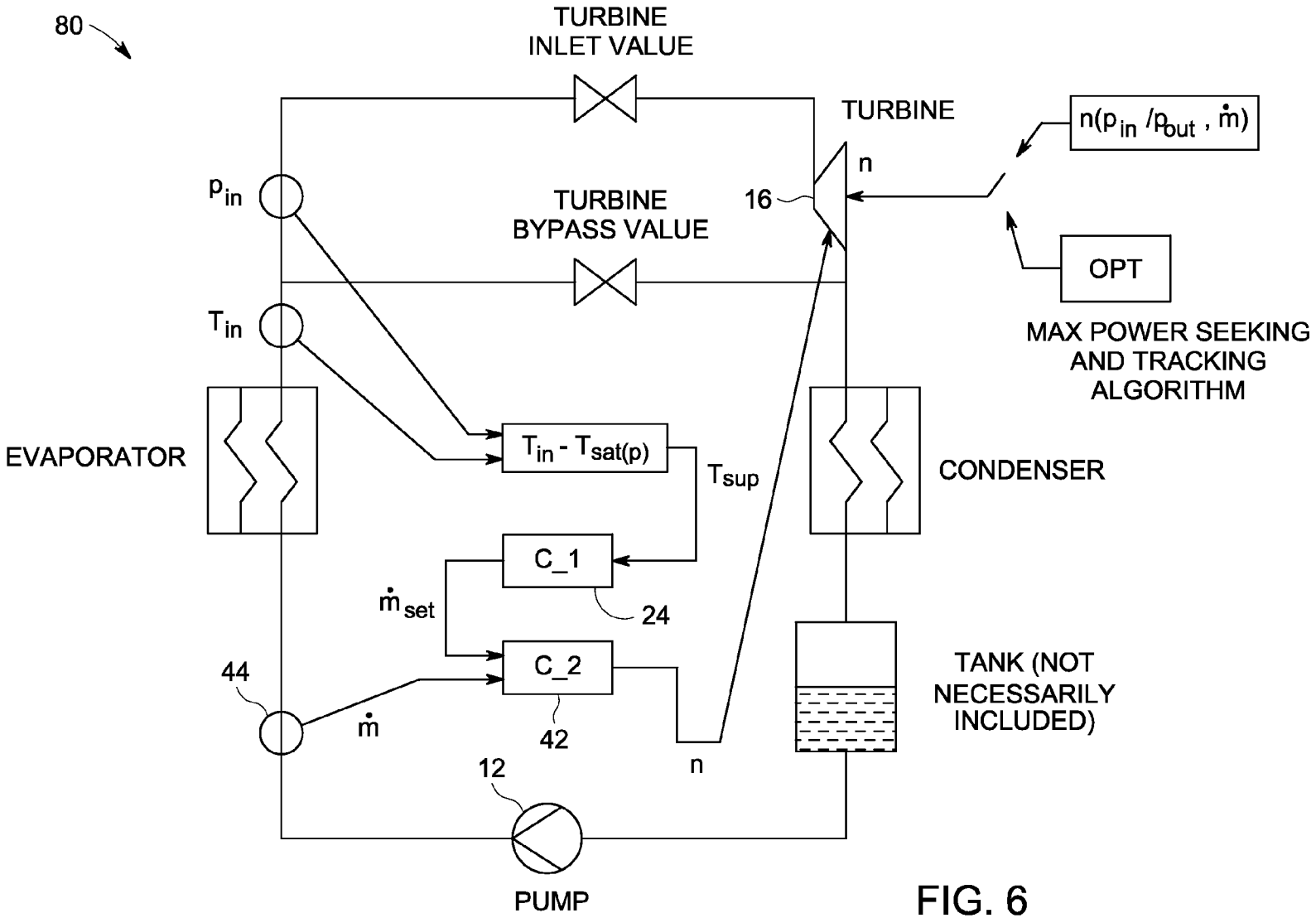
FIG. 6 illustrates an organic Rankine cycle plant with superheated temperature control and subsequent mass flow control according to another embodiment.

FIG. 2 illustrates an organic Rankine cycle plant 40 with superheated temperature control and subsequent mass flow control according to one embodiment. ORC plant 40 is similar to ORC plant 10 in that ORC plant 40 operates to keep a calculated superheated temperature close to a predefined set point. ORC plant 40 however further comprises a mass flow controller 42. Superheat temperature controller 24 functions in this embodiment to substantially maintain the calculated superheated working fluid temperature at the front end of the turbine 16 close to the predefined set point by manipulating the set point of subsequent mass flow controller 42. The mass flow controller 42 manipulates the pump 12 speed such that the measured mass flow provided via one or more mass flow sensors 44 stays close to a mass flow set point based on the output of the superheat temperature controller 24. According to another embodiment shown in ORC plant 80 depicted in FIG. 6, the mass flow controller 42 manipulates the pitch of turbine 16 variable inlet guide vanes such that the measured mass flow provided via the one or more mass flow sensors 44 stay close to the mass flow set point.

ORC plants 40, 80 each comprise a cascaded control system 24, 42 architecture that advantageously provides an improved dynamic response to plants 40, 80 disturbances and any transient changes occurring in the system. The cascaded architecture further prevents undesired undershoot and overshoot of mass flow in the system which can cause a shut down of the whole plant 40, 80.

Figure 3:
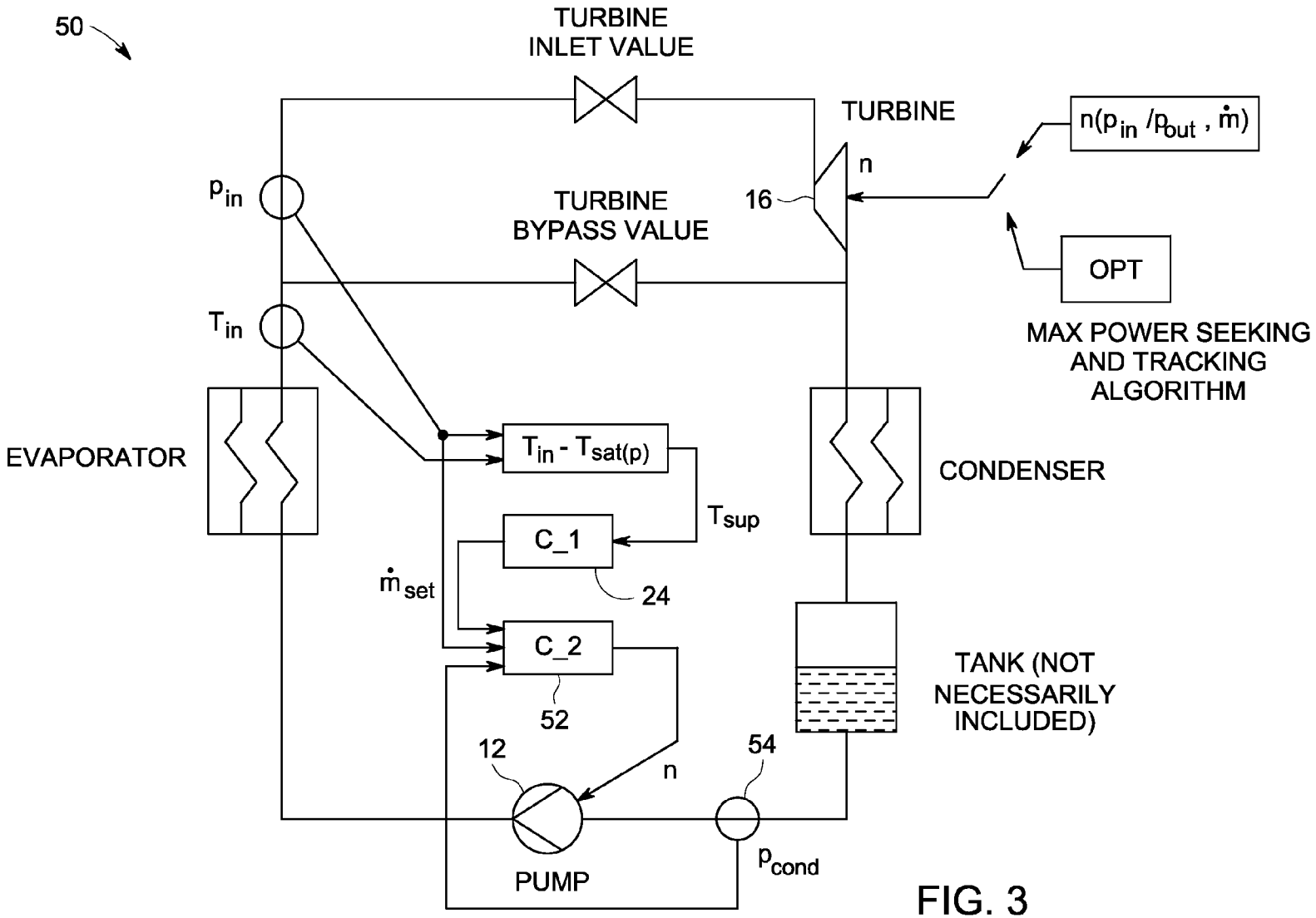
FIG. 3 illustrates an organic Rankine cycle plant with superheated temperature control and subsequent mass flow control devoid of sensors according to one embodiment.
Figure 7:
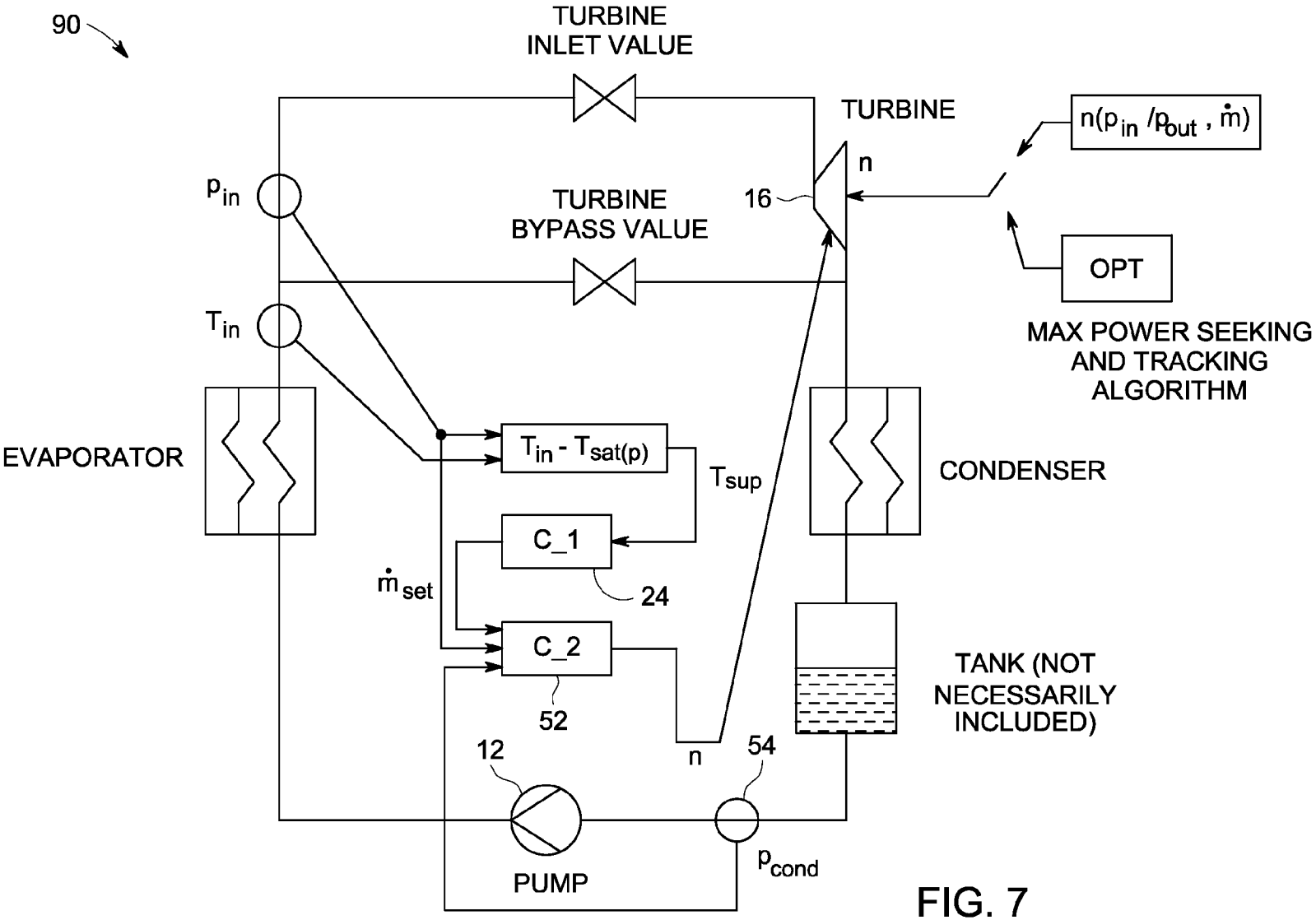
FIG. 7 illustrates an organic Rankine cycle plant with superheated temperature control and subsequent mass flow control devoid of sensors according to another embodiment.

FIG. 3 illustrates an organic Rankine cycle plant 50 with superheated temperature control and subsequent mass flow control that is devoid of mass flow sensors according to one embodiment. ORC plant 50 is similar to ORC plants 40 and 10 in that ORC plant 50 operates to keep a working fluid superheated temperature at the inlet to a radial inflow turbine close to a predefined set point. ORC plant 50 also comprises a mass flow controller 52. Superheat temperature controller 24 functions in this embodiment to substantially maintain the superheated working fluid temperature at the front end of the turbine 16 close to the predefined set point by manipulating the set point of subsequent mass flow controller 52. The mass flow controller 52 manipulates the pump 12 speed in response to an estimated system mass flow based on existing working fluid pressure measurements and known pump 12 characteristics. According to one embodiment, the working fluid pressure measurements are provided via one or more pressure sensors 20 configured to measure working fluid pressure(s) on the output side of pump 12, and one or more pressure sensors 54 configured to measure working fluid pressure(s) at the input side of pump 12. According to another embodiment depicting an ORC plant 90 shown in FIG. 7, the mass flow controller 52 manipulates the pitch of turbine 16 variable inlet guide vanes in response to the estimated system mass flow.

ORC plants 50, 90 thus also each comprise a cascaded control system 24, 52 architecture that advantageously provides an improved dynamic response to plants 50, 90 disturbances and any transient changes occurring in the system. The cascaded architecture further prevents undesired undershoot and overshoot of mass flow in the system which can cause a shut down of the whole plant 50, 90.

Figure 4:
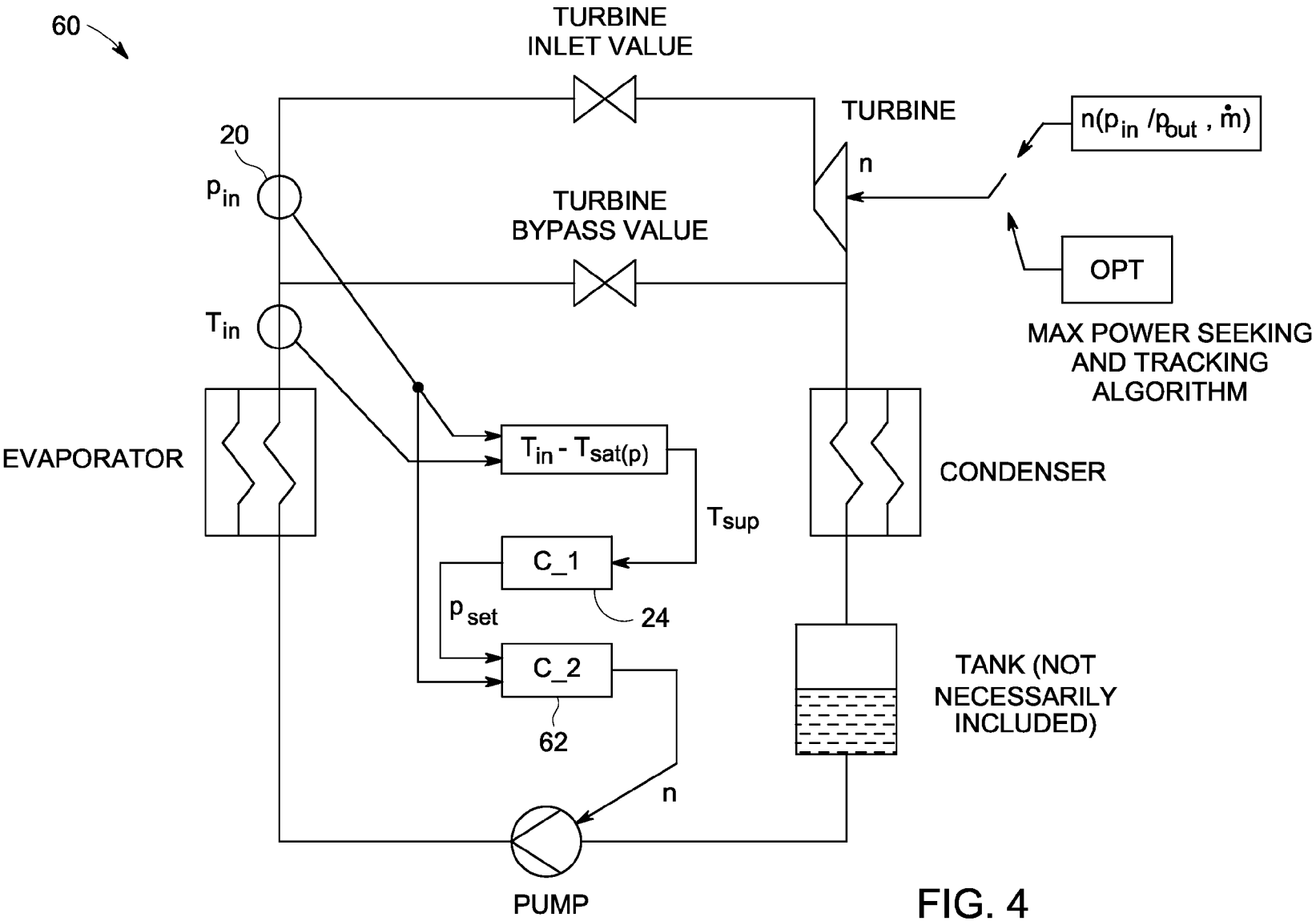
FIG. 4 illustrates an organic Rankine cycle plant with superheated temperature control and subsequent pressure control according to one embodiment.
Figure 8:
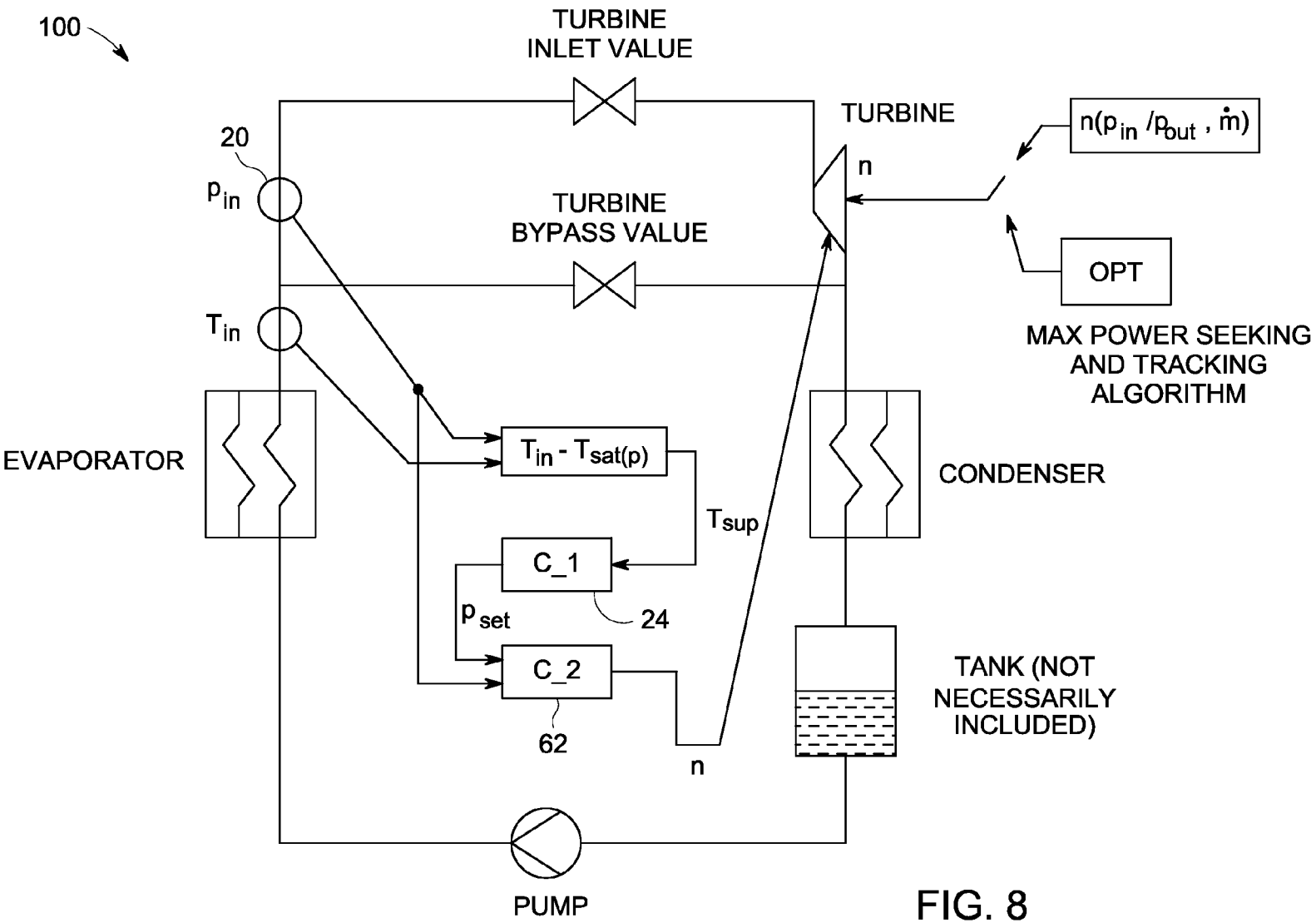
FIG. 8 illustrates an organic Rankine cycle plant with superheated temperature control and subsequent pressure control according to another embodiment.

FIG. 4 illustrates an organic Rankine cycle plant 60 with superheated temperature control and subsequent pressure control according to one embodiment. ORC plant 60 is similar to ORC plant 10 in that ORC plant 60 operates to keep a superheated temperature of a working fluid at the front end of a radial inflow turbine close to a predefined set point. ORC plant 60 however further comprises a subsequent pressure controller 62. Superheat temperature controller 24 functions in this embodiment to substantially maintain the superheated working fluid temperature at the front end of the turbine 16 close to the predefined set point by manipulating the set point of subsequent pressure controller 62. The pressure controller 62 manipulates the pump 12 speed such that the measured pressure provided via one or more pressure sensors 20 stays close to an estimated pressure set point based on the output of the superheat temperature controller 24. According to another embodiment, an ORC plant 100 shown in FIG. 8 comprises a pressure controller 62 that manipulates the pitch of turbine 16 variable inlet guide vanes such that the measured pressure provided via the one or more pressure sensors 20 remains close to the estimated pressure set point.

ORC plants 60 and 100 thus also each comprise a cascaded control system 24, 62 architecture that advantageously provides an improved dynamic response to respective plant 60, 100 disturbances and any transient changes occurring in the system. The cascaded architecture further prevents undesired undershoot and overshoot of mass flow in the system which can cause a shut down of the whole plant 60, 100. Further, the system pressure is advantageously always well defined with the ORC plant 60, 100 architecture.

In summary explanation, techniques according to particular embodiments for controlling organic Rankine cycles using radial inflow turbines have been described herein for maintaining a desired superheating temperature for all operating conditions at the ORC turbine inlet without using sensors other than pressure and temperature sensors. According to another embodiment, a technique for controlling ORCs using radial inflow turbines has been described herein for maintaining a desired superheating temperature for all operating conditions at the ORC turbine inlet without using sensors other than pressure sensors, temperature sensors and mass flow sensors. Superheated conditions at the inlet (front end) of the ORC turbine are required under all operation modes to avoid reduced turbine life expectancy or even immediate damage, as stated herein.

While the invention has been described in terms of various specific embodiments, those skilled in the art will recognize that the invention can be practiced with modification within the spirit and scope of the claims.

What is claimed is:

1. A method of controlling an organic Rankine cycle (ORC) superheated temperature, the method comprising:

measuring ORC working fluid pressure at the inlet side of a radial inflow turbine; measuring ORC working fluid temperature at the inlet side of the radial inflow turbine; determining a superheated temperature at the inlet side of the radial inflow turbine based on the measured working fluid pressure, the measured working fluid temperature, and a saturated vapor line temperature of the working fluid;

manipulating at least one of the speed of an ORC working fluid pump, the pitch of turbine variable inlet guide vanes when the turbine comprises variable inlet guide vanes, and combinations thereof, in response to the determined superheated temperature to substantially maintain the superheated temperature of the working fluid at the inlet side of the radial inflow turbine at a predefined set point;

controlling at least one of the operating the speed of the radial inflow turbine, the pitch of turbine variable inlet guide vanes when the turbine comprises variable inlet guide vanes, and combinations thereof, in response to a set point map, wherein the set point map comprises turbine input/output pressure ratio data and turbine mass flow data;

measuring a working fluid mass flow at the inlet side of the radial inflow turbine; and manipulating at least one of the speed of the pump, the pitch of turbine variable inlet guide vanes when the turbine comprises variable inlet guide vanes, and combinations thereof, in response to the measured working fluid mass flow, and a working fluid mass flow set point based on the determined superheated temperature, such that working fluid mass flow characteristics supersede the determined superheated temperature to directly manipulate at least one of the pump speed, the pitch of the turbine variable inlet guide vanes, and combinations thereof, to substantially maintain the working fluid superheated temperature at the inlet side of the radial inflow turbine at a predefined set point.

2. The method according to claim 1, further comprising:

controlling at least one of the operating speed of the radial inflow turbine, the pitch of turbine variable inlet guide vanes when the turbine comprises variable inlet guide vanes, and combinations thereof, in response to an optimizing algorithm, wherein the optimizing algorithm is configured to seek maximum turbine power output by varying at least one of the turbine speed, the pitch of the turbine variable inlet guide vanes, and combinations thereof, and further wherein the optimizing algorithm is configured to track maximum turbine output power points for changing ambient operating conditions; and continuously optimizing the set point map in response to corresponding maximum turbine power output data and corresponding maximum turbine output power point data.

3. An organic Rankine cycle (ORC) control system comprising:

at least one pressure sensor configured to measure ORC working fluid pressure at the inlet side of a radial inflow turbine;

at least one temperature sensor configured to measure ORC working fluid temperature at the inlet side of the radial inflow turbine;

an optimizing controller comprising an optimizing algorithm, wherein the radial inflow turbine is configured to operate in response to an the optimizing algorithm, and wherein the optimizing algorithm is configured to seek maximum turbine power output by varying at least one of the turbine speed, turbine variable inlet guide vane pitch when the turbine comprises variable inlet guide vanes, and combinations thereof;

a superheat controller configured to:

determine a superheated temperature at the inlet side of the radial inflow turbine based solely on the measured working fluid pressure, the measured working fluid temperature, and a saturated vapor line temperature of the working fluid, and manipulate at least one of the speed of a working fluid pump, the pitch of turbine variable inlet guide vanes when the turbine comprises variable inlet guide vanes, and combinations thereof, in response to the determined superheated temperature to substantially maintain the superheated temperature of the working fluid at the inlet side of the radial inflow turbine at a predefined set point;

a mass flow controller responsive solely to a working fluid mass flow set point based on the determined superheated temperature, a working fluid pressure at the output side of the pump; and a working fluid pressure at the inlet side of the pump, such that the mass flow controller supersedes the superheat controller to directly manipulate at least one of the pump speed, the pitch of the turbine variable inlet guide vanes, and combinations thereof, to substantially maintain the superheated temperature at the inlet side of the radial inflow turbine at a predefined set point.

4. The ORC control system according to claim 3, wherein the superheat controller further comprises a lookup table comprising saturated vapor line temperatures as a function of saturated vapor line pressures to provide the saturated vapor line temperature of the working fluid.

5. The ORC control system according to claim 3, further comprising a set point map for determining at least one of an operating speed of the radial inflow turbine, a turbine variable inlet guide vane pitch when the turbine comprises variable inlet guide vanes, and combinations thereof.

6. The ORC control system according to claim 5, wherein the set point map comprises turbine input/output pressure ratio data and turbine mass flow data.

7. The ORC control system according to claim 3, wherein the optimizing algorithm is configured to track maximum turbine output power points for changing ambient operating conditions.

8. An organic Rankine cycle (ORC) control system comprising:

at least one pressure sensor configured to measure ORC working fluid pressure at the inlet side of a radial inflow turbine;

at least one temperature sensor configured to measure ORC working fluid temperature at the inlet side of the radial inflow turbine;

an optimizing controller comprising an optimizing algorithm, wherein the radial inflow turbine is configured to operate in response to an the optimizing algorithm, and wherein the optimizing algorithm is configured to seek maximum turbine power output by varying at least one of the turbine speed, turbine variable inlet guide vane pitch when the turbine comprises variable inlet guide vanes, and combinations thereof;

a superheat controller configured to:

determine a superheated temperature at the inlet side of the radial inflow turbine based solely on the measured working fluid pressure, the measured working fluid temperature, and a saturated vapor line temperature of the working fluid, and manipulate at least one of the speed of a working fluid pump, the pitch of turbine variable inlet guide vanes when the turbine comprises variable inlet guide vanes, and combinations thereof, in response to the determined superheated temperature to substantially maintain the superheated temperature of the working fluid at the inlet side of the radial inflow turbine at a predefined set point;

a mass flow sensor configured to measure working fluid mass flow at the inlet side of the radial inflow turbine; and a mass flow controller responsive solely to the measured working fluid mass flow, and a working fluid mass flow set point based on the determined superheated temperature, such that the mass flow controller supersedes the superheat controller to directly manipulate at least one of the pump speed, the pitch of the turbine variable inlet guide vanes, and combinations thereof, to substantially maintain the superheated temperature at the inlet side of the radial inflow turbine at a predefined set point.

9. An organic Rankine cycle (ORC) plant comprising:

an evaporator configured to receive a working fluid from a pump and to generate a vapor stream there from;

a radial inflow turbine configured to receive the vapor stream and to generate power and an expanded stream there from;

a condenser configured to receive the expanded stream and to generate the working fluid there from, wherein the working fluid and the vapor stream together form a closed ORC loop;

at least one pressure sensor configured to measure working fluid pressure at the inlet side of the radial inflow turbine;

at least one temperature sensor configured to measure working fluid temperature at the inlet side of the radial inflow turbine;

a set point map for determining at least one of an operating speed of the radial inflow turbine, a turbine variable inlet guide vane pitch when the turbine comprises variable inlet guide vanes, and combinations thereof, wherein the set point map comprises turbine input/output pressure ratio data and turbine mass flow data;

a superheat controller configured to:

determine a superheated temperature at the inlet side of the radial inflow turbine based solely on the measured working fluid pressure, the measured working fluid temperature, and a saturated vapor line temperature of the working fluid, and manipulate at least one of the speed of the pump, the pitch of turbine variable inlet guide vanes when the turbine comprises variable inlet guide vanes, and combinations thereof, in response to the determined superheated temperature to substantially maintain the superheated temperature at the inlet side of the radial inflow turbine at a predefined set point; and a mass flow controller responsive solely to a working fluid mass flow set point based on the determined superheated temperature, a working fluid pressure at the output side of the pump, and a working fluid pressure at the inlet side of the pump, such that the mass flow controller supersedes the superheat controller to directly manipulate at least one of the pump speed, the pitch of the turbine variable inlet guide vanes, and combinations thereof, to substantially maintain the superheated temperature at the inlet side of the radial inflow turbine at a predefined set point.

10. The ORC plant according to claim 9, wherein the superheat controller further comprises a lookup table comprising saturated vapor line temperatures as a function of saturated vapor line pressures to provide the saturated vapor line temperature of the working fluid.

11. The ORC plant according to claim 9, further comprising:

a turbine inlet valve; and turbine bypass valve, wherein the turbine inlet valve is configured to remain closed and the turbine bypass valve is configured to remain open during wet turbine operating conditions.

12. The ORC plant according to claim 9, further comprising an optimizing controller comprising an optimizing algorithm, wherein the radial inflow turbine is configured to operate in response to the optimizing algorithm.

13. The ORC plant according to claim 12, wherein the optimizing algorithm is configured to seek maximum turbine power output by varying at least one of the turbine speed, the pitch of turbine variable inlet guide vanes when the turbine comprises variable inlet guide vanes, and combinations thereof.

14. The ORC plant according to claim 12, wherein the optimizing algorithm is configured to track maximum turbine output power points for changing ambient operating conditions.

15. An organic Rankine cycle (ORC) plant comprising:

an evaporator configured to receive a working fluid from a pump and to generate a vapor stream there from;

a radial inflow turbine configured to receive the vapor stream and to generate power and an expanded stream there from;

a condenser configured to receive the expanded stream and to generate the working fluid there from, wherein the working fluid and the vapor stream together form a closed ORC loop;

at least one pressure sensor configured to measure working fluid pressure at the inlet side of the radial inflow turbine;

at least one temperature sensor configured to measure working fluid temperature at the inlet side of the radial inflow turbine;

a set point map for determining at least one of an operating speed of the radial inflow turbine, a turbine variable inlet guide vane pitch when the turbine comprises variable inlet guide vanes, and combinations thereof, wherein the set point map comprises turbine input/output pressure ratio data and turbine mass flow data;

a superheat controller configured to:

determine a superheated temperature at the inlet side of the radial inflow turbine based solely on the measured working fluid pressure, the measured working fluid temperature, and a saturated vapor line temperature of the working fluid, and manipulate at least one of the speed of the pump, the pitch of turbine variable inlet guide vanes when the turbine comprises variable inlet guide vanes, and combinations thereof, in response to the determined superheated temperature to substantially maintain the superheated temperature at the inlet side of the radial inflow turbine at a predefined set point;

a mass flow sensor configured to measure working fluid mass flow at the inlet side of the radial inflow turbine; and a mass flow controller responsive solely to the measured working fluid mass flow and a working fluid mass flow set point based on the determined superheated temperature, such that the mass flow controller supersedes the superheat controller to directly manipulate at least one of the pump speed, the pitch of the turbine variable inlet guide vanes, and combinations thereof, to substantially maintain the superheated temperature at the inlet side of the radial inflow turbine at a predefined set point.

* * * * *

UNITED STATES PATENT AND TRADEMARK OFFICE

CERTIFICATE OF CORRECTION

PATENT NO. : 8,813,498 B2
APPLICATION NO. : 12/818234
DATED : August 26, 2014
INVENTOR(S) : Kopecek et al.

It is certified that error appears in the above-identified patent and that said Letters Patent is hereby corrected as shown below:

In the Specification,

In Column 4, Lines 17-21, delete "According to one embodiment, the superheat temperature controller 24 and the optimizing controller 36 coexist on the same control platform allowing the turbine speed map 32 to be continuously auto-improved via the optimizing controller 34.".

In the Claims,

In Column 7, Line 9, in Claim 3, delete "an the optimizing" and insert -- the optimizing --, therefor.

In Column 7, Line 67, in Claim 8, delete "an the optimizing" and insert -- the optimizing --, therefor.

Signed and Sealed this
Second Day of December, 2014

Michelle K. Lee

Michelle K. Lee
*Deputy Director of the United States Patent and Trademark Office*